US006908184B2

(12) United States Patent
Shinada et al.

(10) Patent No.: US 6,908,184 B2
(45) Date of Patent: Jun. 21, 2005

(54) INK CARTRIDGE FOR INK-JET PRINTING APPARATUS

(75) Inventors: Satoshi Shinada, Shiojiri (JP); Minoru Usui, Shiojiri (JP); Takahiro Naka, Shiojiri (JP); Takeo Seino, Shiojiri (JP); Koichi Toba, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/465,131

(22) Filed: Jun. 19, 2003

(65) Prior Publication Data

US 2004/0028308 A1 Feb. 12, 2004

Related U.S. Application Data

(63) Continuation of application No. 09/686,877, filed on Oct. 12, 2000, now Pat. No. 6,634,738.

(30) Foreign Application Priority Data

Oct. 12, 1999 (JP) ..... 11-290189

(51) Int. Cl.[7] ..... B41J 2/175
(52) U.S. Cl. ..... 347/86
(58) Field of Search ..... 347/7, 19, 49, 347/50, 85–87

(56) References Cited

U.S. PATENT DOCUMENTS

| | | | | |
|---|---|---|---|---|
| 4,629,164 A | | 12/1986 | Sommerville | |
| 4,771,295 A | * | 9/1988 | Baker et al. | 347/87 |
| 4,961,088 A | | 10/1990 | Gilliland et al. | |
| 4,990,938 A | | 2/1991 | Brandon et al. | |
| 5,049,898 A | | 9/1991 | Arthur et al. | |
| 5,137,379 A | | 8/1992 | Ukai et al. | |
| 5,138,344 A | | 8/1992 | Ujita | |
| 5,208,610 A | | 5/1993 | Su et al. | |
| 5,414,452 A | | 5/1995 | Accatino et al. | |
| D365,596 S | | 12/1995 | Mivazawa et al. | |

(Continued)

FOREIGN PATENT DOCUMENTS

| | | |
|---|---|---|
| DE | G 91 16 990.9 U1 | 1/1995 |
| EP | 0412459 | 2/1991 |
| EP | 0 440 261 | 8/1991 |
| EP | 0 498 117 A2 | 8/1992 |
| EP | 0 639 462 A2 | 2/1995 |

(Continued)

OTHER PUBLICATIONS

U.S. Appl. No. 09/318,268, filed May 25, 1999, Matsumoto et al.

(Continued)

*Primary Examiner*—Stephen D. Meier
*Assistant Examiner*—An H. Do
(74) *Attorney, Agent, or Firm*—Stroock & Stroock & Lavan LLP

(57) ABSTRACT

An ink cartridge for an ink jet printing apparatus having a printhead which ejects ink droplets onto a recording medium and an ink supply needle introducing ink to the printhead, the ink cartridge having a substantially rectangular housing containing ink therein, the housing having a first outer wall and a second outer wall which is substantially perpendicular to the first outer wall; an ink supply port formed in the first wall for directing ink in the housing to the printhead; a valve mechanism arranged in the ink supply port including a valve seat allowing the ink supply needle to pass therethrough; a valve body movable along the axis of the ink supply port; and an elastic member biasing the valve body against the valve seat, and a memory device for storing information relating to ink mounted on the second wall of the housing and substantially in parallel therewith, the memory device being formed in the vicinity of the ink supply port, which wall directing in parallel with a direction along which the ink supply needle is inserted into the valve seat.

19 Claims, 9 Drawing Sheets

U.S. PATENT DOCUMENTS

| | | | | | |
|---|---|---|---|---|---|
| 5,491,540 | A | | 2/1996 | Hirst | |
| D369,383 | S | | 4/1996 | Miyazawa et al. | |
| 5,506,611 | A | | 4/1996 | Ujita et al. | |
| 5,528,269 | A | | 6/1996 | Drogo et al. | |
| 5,610,635 | A | | 3/1997 | Murray et al. | |
| 5,640,186 | A | | 6/1997 | Swanson et al. | |
| 5,646,660 | A | | 7/1997 | Murray | |
| 5,691,753 | A | | 11/1997 | Hilton | |
| 5,699,091 | A | | 12/1997 | Bullock et al. | |
| 5,751,320 | A | | 5/1998 | Scheffelin et al. | |
| 5,788,388 | A | | 8/1998 | Cowger et al. | |
| 5,812,156 | A | | 9/1998 | Bullock et al. | |
| 5,835,817 | A | | 11/1998 | Bullock et al. | |
| 5,861,897 | A | | 1/1999 | Ide et al. | |
| 5,886,721 | A | * | 3/1999 | Fujii et al. | 347/87 |
| 5,949,459 | A | | 9/1999 | Gasvoda et al. | |
| 5,975,677 | A | | 11/1999 | Marler et al. | |
| 6,011,937 | A | | 1/2000 | Chaussade et al. | |
| 6,015,209 | A | * | 1/2000 | Barinaga et al. | 347/86 |
| 6,017,118 | A | | 1/2000 | Gasvoda et al. | |
| 6,019,461 | A | | 2/2000 | Yoshimura et al. | |
| 6,036,305 | A | | 3/2000 | Nagasaki et al. | |
| 6,039,430 | A | | 3/2000 | Helterline et al. | |
| 6,065,824 | A | | 5/2000 | Bullock et al. | |
| 6,074,042 | A | | 6/2000 | Gasvoda et al. | |
| 6,109,723 | A | | 8/2000 | Castle et al. | |
| 6,126,265 | A | | 10/2000 | Childers et al. | |
| 6,130,695 | A | * | 10/2000 | Childers et al. | 347/85 |
| 6,155,678 | A | | 12/2000 | Komplin et al. | |
| 6,168,262 | B1 | | 1/2001 | Clark et al. | |
| 6,170,939 | B1 | * | 1/2001 | Ujita et al. | 347/86 |
| 6,170,940 | B1 | | 1/2001 | Shinada et al. | |
| 6,196,670 | B1 | | 3/2001 | Saruta | |
| 6,227,643 | B1 | * | 5/2001 | Purcell et al. | 347/19 |
| 6,276,788 | B1 | | 8/2001 | Hilton | |
| 6,312,088 | B1 | | 11/2001 | Seino | |
| 6,332,481 | B1 | * | 12/2001 | Shinada et al. | 141/18 |
| 6,361,138 | B1 | | 3/2002 | Seino et al. | |
| 6,371,586 | B1 | | 4/2002 | Saruta | |
| 6,416,152 | B1 | | 7/2002 | Matsuzaki et al. | |
| 6,447,090 | B1 | | 9/2002 | Saruta | |
| 6,502,916 | B1 | | 1/2003 | Naka | |
| 6,502,917 | B1 | | 1/2003 | Shinada et al. | |
| 6,634,738 | B1 | * | 10/2003 | Shinada et al. | 347/86 |
| 2001/0007458 | A1 | | 7/2001 | Purcell et al. | |
| 2002/0015067 | A1 | | 2/2002 | Studholme | |

FOREIGN PATENT DOCUMENTS

| | | | |
|---|---|---|---|
| EP | 0 710 568 | A2 | 5/1996 |
| EP | 0 713 778 | A2 | 5/1996 |
| EP | 0 778 145 | B1 | 6/1997 |
| EP | 0 778 148 | B1 | 6/1997 |
| EP | 0 789 322 | A2 | 8/1997 |
| EP | 0 822 084 | A2 | 2/1998 |
| EP | 0 832 747 | A2 | 4/1998 |
| EP | 0 839 660 | A1 | 5/1998 |
| EP | 0 940 260 | | 9/1999 |
| EP | 0 960 736 | A1 | 12/1999 |
| EP | 0 963 847 | | 12/1999 |
| EP | 0 985 537 | A1 | 3/2000 |
| EP | 0 997 297 | | 5/2000 |
| EP | 0 999 063 | | 5/2000 |
| EP | 1 004 449 | A2 | 5/2000 |
| EP | 1 038 682 | | 9/2000 |
| EP | 1 080 917 | | 4/2002 |
| JP | 2594912 | | 8/1987 |
| JP | 62-184856 | | 8/1987 |
| JP | 2-99333 | | 4/1990 |
| JP | 3-67657 | | 3/1991 |
| JP | 4-247955 | | 9/1992 |
| JP | 5-229137 | | 9/1993 |
| JP | 6-126981 | | 5/1994 |
| JP | 6-155758 | | 6/1994 |
| JP | 7-81077 | | 3/1995 |
| JP | 7-232438 | | 9/1995 |
| JP | 7-232439 | A | 9/1995 |
| JP | 8-132635 | | 5/1996 |
| JP | 8-197748 | | 8/1996 |
| JP | 9-174876 | | 7/1997 |
| JP | 9-174879 | | 7/1997 |
| JP | 10-146680 | | 6/1998 |
| JP | 10-151882 | | 6/1998 |
| JP | 10-151883 | | 6/1998 |
| JP | 2000-177145 | | 6/2000 |
| WO | WO 96/05061 | A1 | 2/1996 |
| WO | WO 97/23352 | A1 | 7/1997 |
| WO | WO 98/52762 | A2 | 11/1998 |
| WO | WO 98/55318 | | 12/1998 |
| WO | WO 98/55322 | | 12/1998 |
| WO | WO 98/55323 | | 12/1998 |
| WO | WO 98/55324 | | 12/1998 |
| WO | WO 98/55325 | | 12/1998 |
| WO | WO 99/65695 | | 12/1999 |
| WO | WO 00/21756 | A1 | 4/2000 |
| WO | WO 00/26034 | A2 | 5/2000 |
| WO | WO 00/47417 | | 8/2000 |
| WO | WO 01/54910 | | 8/2001 |
| WO | WO 02/11986 | A2 | 2/2002 |

OTHER PUBLICATIONS

U.S. Appl. No. 09/432,272, filed Nov. 2, 1999, Saruta et al.
U.S. Appl. No. 09/442,646, filed Nov. 18, 1999, Saruta et al.
U.S. Appl. No. 09/449,732, filed Nov. 26, 1999, Saruta.

* cited by examiner

INK CARTRIDGE FOR INK-JET PRINTING APPARATUS

CROSS-REFERENCE TO RELATED APPLICATIONS

This patent application is a continuation of application Ser. No. 09/686,877, filed on Oct. 12, 2000, now U.S. Pat. No. 6,634,738.

BACKGROUND OF THE INVENTION

This patent application claims priority based on a Japanese patent application, H11-290189 filed on Oct. 12, 1999, the contents of which are incorporated herein by reference.

BACKGROUND OF THE INVENTION

1. Field of the Invention

The present invention relates to an ink cartridge detachably attached to a printing apparatus and supplying ink to a printhead of the printing apparatus which ejects ink droplets in accordance with a printing signal.

2. Related Art

Typically, a printhead of an ink-jet printing apparatus connects with an ink cartridge via an ink supply channel. The printhead is designed to receive ink from the ink cartridge. The printing apparatus is provided with a hollow ink supply needle in the ink supply channel to supply ink to the printhead. The ink cartridge is formed with an ink supply port for supplying ink to the printhead. When the ink cartridge is mounted on the printing apparatus, the hollow ink supply needle is inserted into the ink supply port of the ink cartridge and ink is supplied to the printhead via the hollow ink supply needle.

Unexamined Japanese patent applications (OPI) Nos. Hei. 5-229137 and Hei. 9-174879 disclose an ink cartridge of this structure including a valve member at an upper part of the ink supply port, i.e., inside of the ink cartridge. The ink supply port of the ink cartridge of this type opens when the ink supply needle is inserted, and closes when the ink supply needle is removed. Thus, the ink cartridge is capable of preventing leakage of ink or is capable of being repeatedly attached to the printing apparatus. On the other hand, Unexamined Japanese patent application (OPI) No. Hei. 7-232438 discloses an ink cartridge having a semiconductor memory device that stores data relating to the ink cartridge.

The conventional valve member as mentioned above, however, has a drawback as the connection between the semiconductor memory device of the ink cartridge and a control unit of the printing apparatus is inadequate. More specifically, as the valve member is always urged by a spring in an insertion direction of the ink supply needle in order to seal the ink supply port, the ink cartridge does not completely fit to a carriage of the printing apparatus because the resilient force of the spring pushes the cartridge up to some extent with respect to the carriage after the ink cartridge is mounted on the carriage. Such results in that the accurate positioning of the ink cartridge with respect to the carriage is hardly accomplished, and if a memory device is mounted on the ink cartridge, the connection of terminals of the memory device to the contact member of a circuit unit of the printing apparatus may be failed due to the deviation caused by the resilient force of the spring urging the valve member.

Further, if the conventional ink cartridge is detached from the carriage of the printing apparatus to exchange to a cartridge of different kind or type while the original ink cartridge is not depleted, the ink may leak out of the ink cartridge through the ink supply port. Such a problem would be more emphasized when the ink cartridge is recycled and the valve or packing becomes worn out and, accordingly, the sealability of the valve mechanism is deteriorated.

In addition, if the memory device comes into contact the terminal of the printing apparatus whereas the ink supply needle does not correctly enter the ink supply port and thus still not ready for supplying ink, the printing operation may start and air would be conveyed to the nozzles of the printhead. Such could result in a serious problem in giving damage to the printhead, and no recovery can be expected without exchanging the printhead. Therefore, it has been required an appropriate interrelationship of the contact electrode of the memory device with the engagement between the ink supply port and the ink supply needle.

SUMMARY OF THE INVENTION

The present invention was made in view of the foregoing drawbacks accompanying the conventional ink cartridge. Therefore, it is an object of the present invention to provide an ink cartridge capable of performing an adequate connection between a memory device mounted on the ink cartridge and an external circuit unit, regardless of a reactive resilient force of a spring for urging a valve, so that the memory device of the ink cartridge is capable of electrically connecting in a stable manner with the external circuit unit.

Another object of the present invention is to provide an ink cartridge capable of preventing ink from leaking out through the ink supply port even though the ink cartridge is detached from the printing apparatus for exchanging while ink is not depleted.

Still another object of the invention is to provide an ink cartridge capable of achieving an appropriate interrelationship of the contact electrode of the memory device with the engagement between the ink supply port and the ink supply needle.

The above and other objects can be attained by a provision of an ink cartridge for an ink jet printing apparatus having a printhead which ejects ink droplets onto a recording medium and an ink supply needle introducing ink to the printhead which, according to the present invention, includes: a substantially rectangular housing for containing ink therein, said housing having a first outer wall and a second outer wall which is substantially perpendicular to said first outer wall; an ink supply port formed in said first wall for directing ink in said housing to the printhead; a valve mechanism arranged in said ink supply port comprising: a valve seat allowing the ink supply needle to pass therethrough; a valve body movable along the axis of said ink supply port; and an elastic member biasing said valve body against said valve seat, and a memory device for storing information relating to ink mounted on said second wall of said housing and substantially in parallel therewith, said memory device being arranged in the vicinity of said ink supply port, and said second wall extending in a direction parallel with a direction along which the ink supply needle is insertable into said valve seat, said memory device comprising a substrate and a plurality of electrode terminals arranged on one surface of said substrate.

The memory device may be disposed on a center line of the second wall of the housing. The second wall may have a projection which engages with a hook of an ink cartridge holder of the printing apparatus. The housing may be formed with a concave portion in which the memory device is accommodated. The ink cartridge according to any one of the preceding claims, wherein the housing comprises a plurality of ink chambers for different ink, each chamber comprising an ink supply port, and the memory device is disposed substantially at a center of the total width of the plurality of ink chambers. The memory device comprises a substrate, a plurality of electrode terminals arranged on one surface of the substrate and a storage device disposed on the other surface of the substrate. According to the invention, the memory device may include: a substrate; an electrode terminal arranged on one surface of the substrate at a position where the terminal electrically connects to a contact member of the printing apparatus when the ink supply needle is inserted into the valve seat up to a regular position where the ink supply needle feeds ink; and a storage device secured on the substrate, the storage device communicating with the printing apparatus when the ink cartridge is mounted on the printing apparatus.

According to the invention, the length of the terminal along the direction of insertion of the ink supply needle into the valve seat is longer than the maximum length of entry of the ink supply needle into the ink supply port from the valve seat, subtracted by a length that the ink supply needle is pushed back by a resilient force of the elastic member as a reactive force thereof generated by urging the valve body. The terminal starts to connect electrically with the contact member of the printing apparatus when the tip end portion of the ink supply needle comes into contact with the valve body. The terminal along the direction of insertion of the ink supply needle into the valve seat is longer than the length that the ink supply needle slides into the housing while pushing the valve body against the elastic member. The housing comprises a cover plate, the cover plate includes: a through-hole; an elongated groove which is in fluid communication with the inside of the housing through the through-hole; and a film covering the top of both the through-hole and the groove so that air flows through the groove and the through-hole into the housing.

The ink cartridge further includes a cylindrical packing member disposed in the ink supply port for communicating an interior of the housing with the printhead through the ink supply needle, wherein the valve body of the valve mechanism is disposed at the housing side of the cylindrical packing member, and always urged by the elastic member to seal the cylindrical packing member. The ink cartridge may further includes a. porous member accommodated in the housing for holding ink. A capillary force of the porous member is greater in the vicinity of the ink supply port than other parts of the porous member.

According to another aspect of the invention, the above objects can be achieved by a provision of an ink jet printing apparatus which includes: a printhead for ejecting ink droplets onto a recording medium; and an ink container supplying ink contained therein to the printhead, the ink container comprising: a first wall; a second wall; and an ink supply port formed in the first wall for directing ink in the ink container to the printhead; an ink supply needle for feeding ink from the ink container to the printhead by being inserted into the ink supply port; a valve mechanism arranged in the ink supply port comprising: a valve seat allowing the ink supply needle to pass therethrough; a valve body movable along an axis of the ink supply port; and an elastic member biasing the valve body against the valve seat; and a memory device for storing information relating to ink disposed on the second wall of the container, which second wall extends in a direction parallel with a direction along which the ink supply needle is inserted into the ink supply port, the memory device comprising a substrate and a plurality of electrode terminals arranged on one surface of the substrate.

According to still another aspect of the invention, an ink cartridge for an ink jet printing apparatus includes: a cylindrical packing member in an ink supply port thereof for communicating an ink chamber with a printhead through an ink supply needle; and a memory device having electrodes for connection, wherein said electrodes for connection accomplish a conductive relation with external contacts under a condition where the ink supply needle assuredly engages with the cylindrical packing member to allow ink to be supplied.

According to still another object of the invention, the above objects can be achieved by a provision of an ink cartridge communicating an ink chamber with a printhead through an ink supply needle and comprising a re-seal structure arranged in an ink supply port thereof, in which the ink cartridge includes a memory device for storing thereon information relating to the ink cartridge and a porous member for holding ink arranged at the ink chamber side of the re-seal member.

The ink chamber communicates with ambient air through a capillary action formed in a surface of the cartridge body. The re-seal structure is capable of supplying ink to the printhead in response to a negative pressure applied from the printhead, a porous member for holding ink is disposed, and a packing member is formed at the ink chamber side with a slit which is openable by the insertion of the ink supply needle.

According to still another object of the invention, the above objects can be attained by a provision of an ink cartridge for an ink jet printing apparatus which comprises a cylindrical packing in an ink supply port thereof for communicating an ink chamber with a printhead through an ink supply needle, wherein a valve body is disposed at an ink chamber side of the cylindrical packing, and always urged by a spring to seal the cylindrical packing, and a memory means, having electrodes for connection, is disposed on a wall of the ink cartridge, which wall being in parallel with an insertion direction of the ink supply needle.

The memory means is disposed on a wall which is in the vicinity of the ink supply port. The memory means has a region on which data of ink consumption amount is stored. The memory means has a region on which a recycling information of the ink cartridge is stored. The memory means may have one surface forming a front surface on which the electrodes for external connection are formed and a rear surface on which a semiconductor storage means is installed. Further, a porous member is housed in the ink chamber at least in the vicinity of the valve body. A porous member is housed in the ink chamber and a filter is provided upstream of the valve body. In addition, a cover plate for sealing an upper part of the ink chamber is formed with an air hole which communicates with ambient air through fine grooves formed in the surface of the cover plate.

DETAILED DESCRIPTION OF THE INVENTION

The present invention will now be described in detail with reference to accompanying drawings. This does not intend to limit the scope of the preset invention, but: exemplify the invention. All of the features and the combinations thereof described in the embodiment are not necessarily essential to the invention.

Figure 1A:
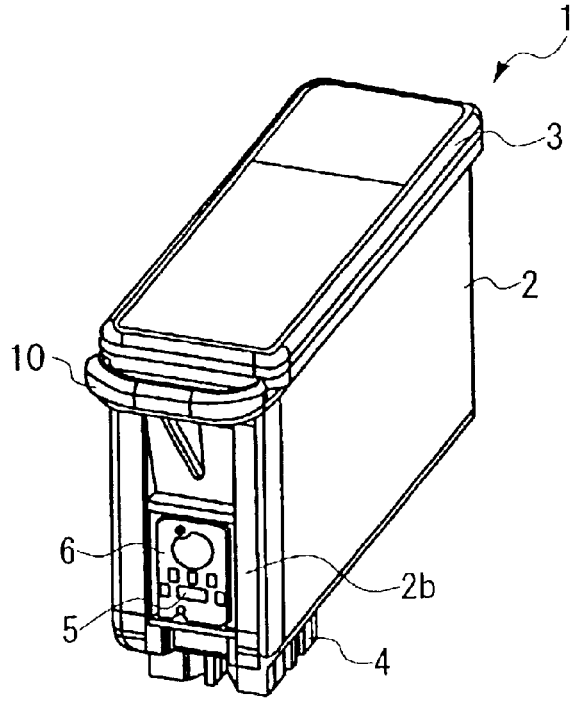
FIG. 1A shows a perspective view of a black ink cartridge according to the present invention viewed from above.
Figure 1B:
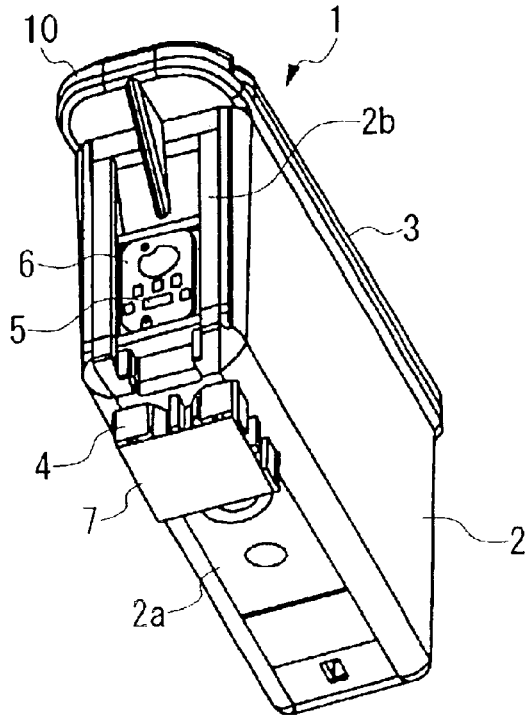
FIG. 1B shows a perspective view of the black ink cartridge according to the present invention viewed from below.

FIGS. 1A and 1B show, merely as an example, a black ink cartridge for an ink-jet printing apparatus. As shown in the figures, an ink cartridge 1 is substantially rectangular parallelepiped. The ink cartridge 1 is provided with a housing 2 formed with an ink chamber 60 (shown in FIG. 4) and an opening, and a cover member 3 sealing the opening of the housing 2. The ink cartridge 1 further includes an ink supply port 4 formed in one outer wall thereof, i.e., a bottom wall 2*a* in this embodiment. The printing apparatus includes a printhead with nozzles and an ink supply needle which is held in fluid communication with the printhead. The ink supply port 4 of the ink cartridge 1 is designed to supply ink to the printhead through the ink supply needle of the printing apparatus when the ink cartridge 1 is mounted on the printing apparatus and the ink supply needle is inserted in the ink supply port 4. The bottom wall 2*a* has substantially square shape formed with two edges of longer width and the other two edges of shorter width. The ink supply port 4 is formed at a position closer to one of the shorter edges than the other of the shorter edges.

The ink cartridge 1 further includes a memory device 6 having a circuit substrate secured to one wall other than the bottom wall 2*a*. The memory device 6 is placed in the vicinity of the ink supply port 4 and preferably, on a side outer wall 2*b* which is in parallel with the insertion direction of the ink supply needle 52, shown in FIG. 4. As shown in FIGS. 1A and 12, the memory device 6 is disposed on a center line of the side wall 2*b* of the housing 2, which wall has a shorter width than the other wall of the housing 2. The housing 2 is substantially rectangular in shape, and the side wall 2*b* of which is substantially perpendicular to the bottom wall 2*a* on which the ink supply port 4 is formed. Further, the memory device, which has a flat substrate, is disposed substantially in parallel with the side wall 2*b*.

Because the ink supply port 4 of the ink cartridge 1 must be accurately positioned with respect to the ink supply needle of the printing apparatus, more accurate positioning around the ink supply port is accomplished than the other part of the ink cartridge. Accordingly, as the memory device 6 is disposed in the vicinity of the ink supply port 4 according to the present embodiment, an accurate positioning of the memory device 6 with respect to the contact member of the printing apparatus side is necessarily attained. In addition, when the ink cartridge 1 is mounted on the carriage, the level of deviation in position of the ink cartridge 1 with the carriage is less at the center of the ink cartridge than at the side edge parts thereof. Therefore, as the memory device 6 is disposed at the center in the widthwise direction of the side wall 2*b*, the level of deviation in position of the memory device 6 is necessarily less.

According to the present embodiment, the housing 2 is formed with a concave portion 101 in which the memory device 6 is accommodated.

The ink supply port 4 is initially sealed with a sealing member 7 so that air or bubbles do not enter the ink supply port 4 or ink does not leak out of the ink supply port 4 before use. The ink cartridge 1 is formed with a protruding portion 10 which is designed to engage with a hook 102 of a cartridge holder of the printing apparatus for the purpose of aiding mounting and detaching of the ink cartridge 1 on and from the cartridge holder of the printing apparatus. As the protruding portion 10 extends from the side wall 2*b* on which the memory device 6 is mounted, the positioning accuracy of the memory device with the contact member of the printing apparatus can be attained.

Figure 2A:
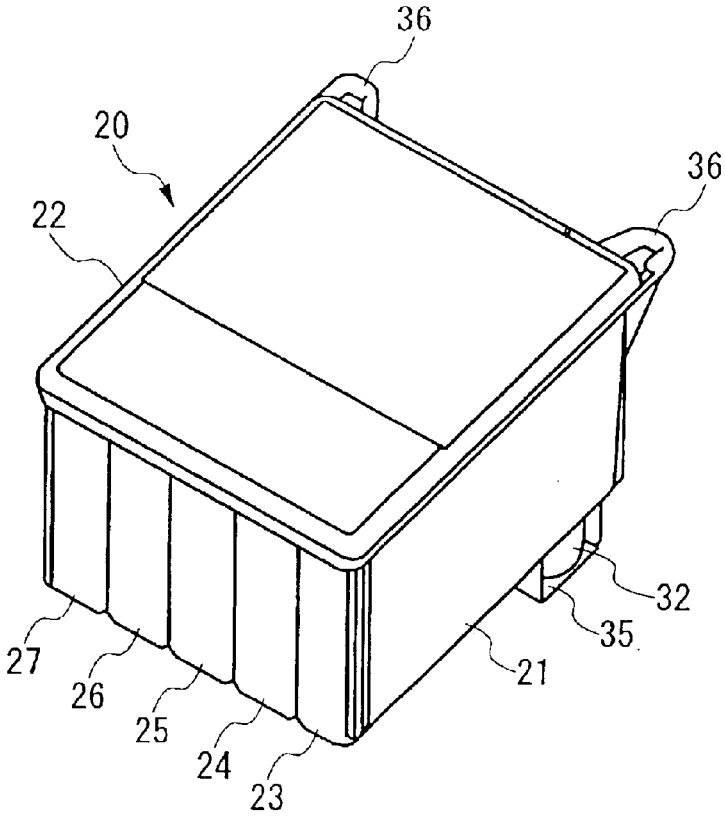
FIG. 2A shows a perspective view of a color ink cartridge according to the present invention viewed from above.
Figure 2B:
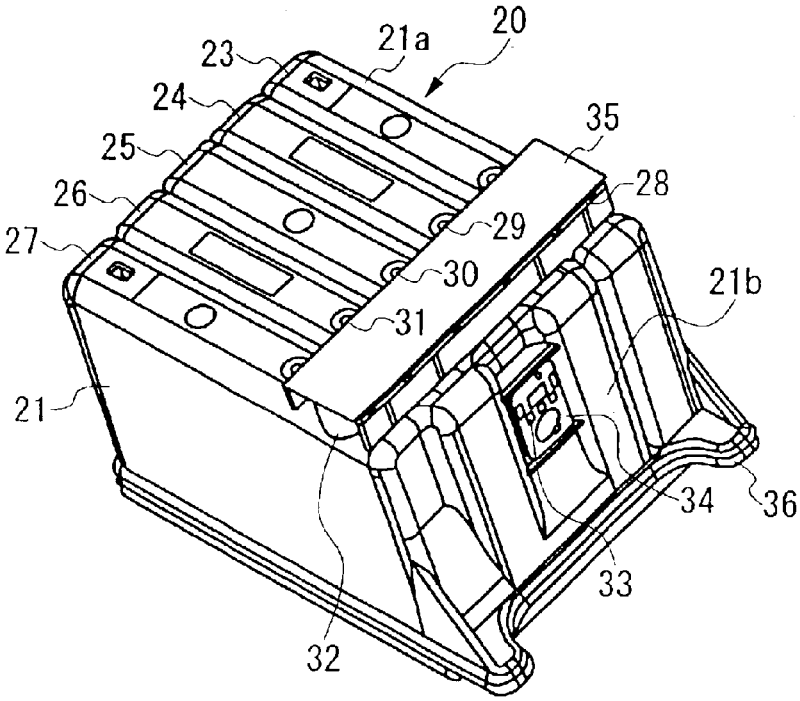
FIG. 2B shows a perspective view of the color ink cartridge according to the present invention viewed from below.

FIGS. 2A and 2B show, as an example, a color ink cartridge 20. Similar to the black ink cartridge 1 shown in FIGS. 1A and 1B, the ink cartridge 20 is substantially rectangular parallelepiped. The ink cartridge 20 has a housing 21 the interior of which is separated into a plurality of ink chambers by partition walls for accommodating different inks such as different color. According to this embodiment shown in FIGS. 2A and 2B, five ink chambers 23 to 27 are defined, and each of the ink chambers 23 to 27 has an opening. The ink cartridge further 20 has a cover member 35 sealing all the openings of the ink chambers 23 to 27. The ink cartridge 20 includes a plurality of ink supply ports 28 to 32 on one of its sides, each corresponding to the ink chambers 23 to 27. Each of the ink supply ports 28 to 32 is held in communication with the respective ink chambers 23 to 27, and is capable of providing ink to a corresponding ink supply needle when the ink supply needle is inserted into each of the ink supply ports 28 to 32. As illustrated in FIG. 2B, the ink supply ports 28 to 32 are formed at positions closer to one edge of a wall the other.

The ink cartridge 20 is further provided with a memory device 34 secured to one wall other than the wall on which the ink supply ports 28 to 32 are formed. According to the present embodiment, as shown in FIG. 2B, the memory device 34 is disposed substantially at a center of the total width of the plurality of ink chambers 23 to 27. The memory device 34 is positioned in the vicinity of the ink supply ports 28 to 32 and stores therein, for example, data for specifying the ink cartridge 20.

The ink supply ports 28 to 32 are initially sealed with a sealing member 35 so that air or bubbles do not enter ink supply ports 28 to 32 or ink does not leak out of the ink supply ports 28 to 32 before use. The ink cartridge 20 is formed with a protruding portion 36 which is designed to engage with a hook of the printing apparatus for aiding mounting and detaching of the ink cartridge 20 on the cartridge holder of the printing apparatus.

Figure 3A:
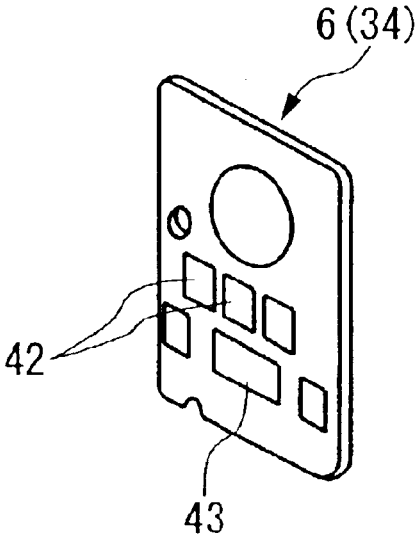
FIG. 3A shows a perspective view of the circuit substrate showing the first side.
Figure 3B:
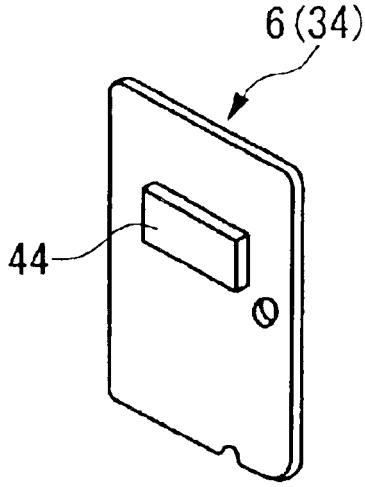
FIG. 3B shows a perspective view of the circuit substrate showing the second side.

FIGS. 3A and 3B are perspective views of the memory device 6 or 34, showing a first side and a second side, respectively. When the memory device 6 or 34 is mounted to the ink cartridge 1 or 20, respectively, the second side shown in FIG. 3B is attached to the ink cartridge 1 or 20. Thus, the first side shown in FIG. 3A is seen on the surface. The first side is formed with electrodes 42 and 43 which are designed to connect to a contact 40, shown in FIG. 4, of the cartridge holder of the printing apparatus. A semiconductor storage device 44 is attached on the second side, i.e., rear side of the memory device 6 or 34. The semiconductor storage device 44 can be accessed by the cartridge holder of the printing apparatus via the electrode 42 and 43 of the memory device 6 or 34 and the contact 40, so that information relating to ink or ink cartridge can be stored in or read out from the storage device 44. The memory device 6 is provided with a substrate 103, a plurality of electrode terminal; 42, 43 and the semiconductor storage device 44. The electrode terminals 42, 43 are arranged on a front surface of the substrate 103 and the storage device 44 is disposed on the other, rear surface of the substrate 103. Because the semiconductor storage device, i.e., the chip; is disposed on the rear side of the substrate 103, it is not exposed when the memory device is attached to the ink cartridge 1 and there is no possibility that a user may cause damage even though he drops the ink cartridge 1 on a floor.

The semiconductor storage device 44 is formed of an electrically rewritable memory such as a nonvolatile memory such as, for example, EEPROM. When the ink cartridge 1 or 20 is shipped from a manufacturing factory, data related to ink or to the ink cartridge 1 or 20 is previously written on the semiconductor storage device 44. The previously written data may be, for example, a serial number for specifying the cartridge 1 or 20, volume of ink contained in the ink cartridge 1 or 20, and data related to a trademark indicating a manufacturer of ink or the ink cartridge 1 or 20. The semiconductor storage device 44 is formed to have an area where a volume of ink consumed by a user can be written on.

Figure 4:
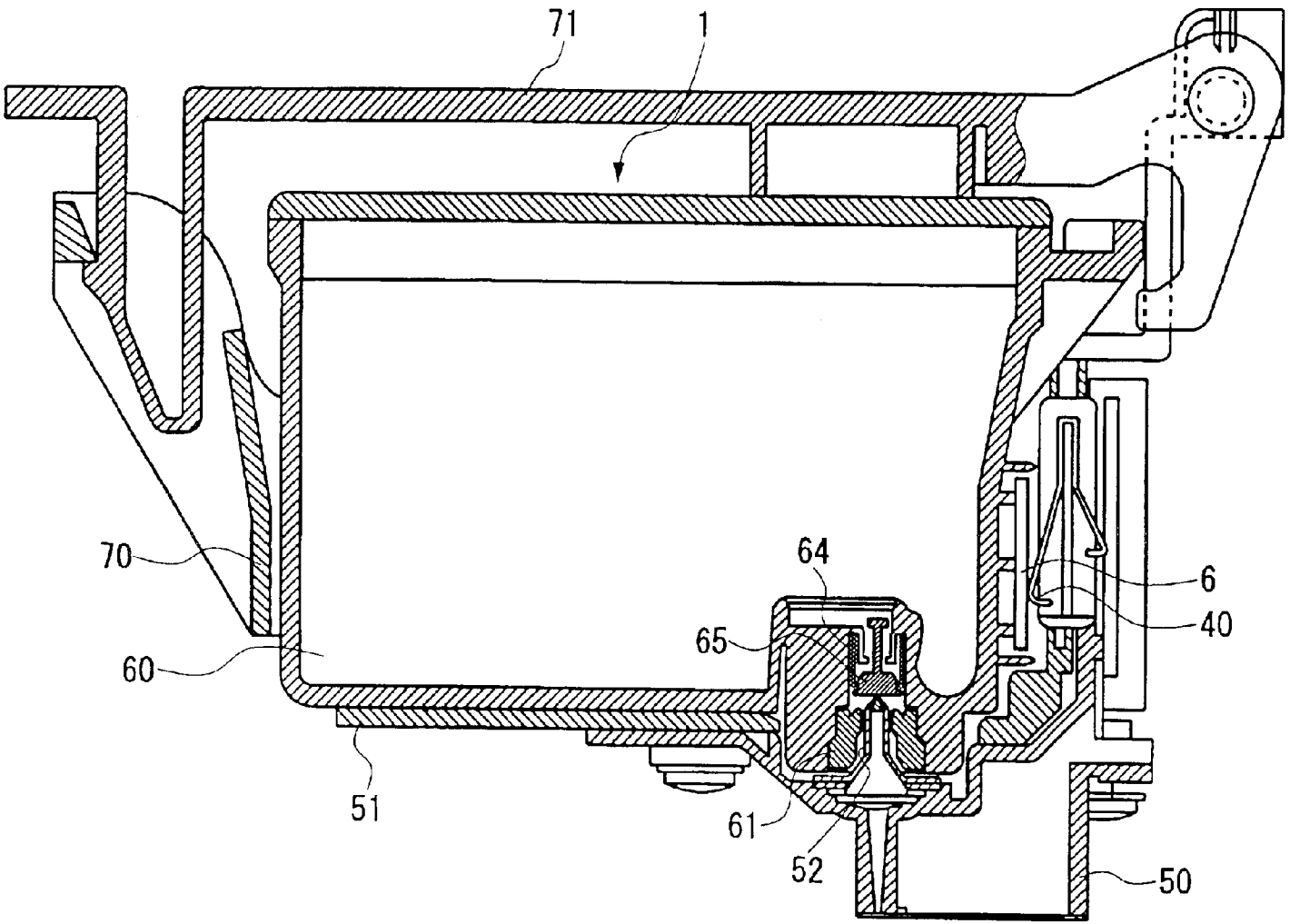
FIG. 4 shows a cross sectional view of the black ink cartridge when mounted on a carriage of the printing apparatus.

FIG. 4 shows a cross sectional view of the black ink cartridge 1 when mounted on a carriage 51 of the printing apparatus. The printing apparatus includes a printhead 50 and an ink supply needle 52. When the ink cartridge 1 is mounted on a predetermined position of the carriage 51 on which the printhead 50 is secured, the ink supply needle 52 forms a sealing connection with the ink supply port 4 of the ink cartridge 1 to be held in communication with the ink chamber 60 via the ink supply port 4.

The ink supply needle 52 is hollow and formed from a cylindrical body having a tapered portion at its tip end. Therefore, the ink supply needle 52 is easily inserted into and removed from the ink supply port 4. When the ink supply needle 52 is inserted in the ink supply port 4, the ink supply needle 52 forms a sealing connection with a packing member 61 fitted in the ink supply port 4, which will be described herein below.

Figure 5:
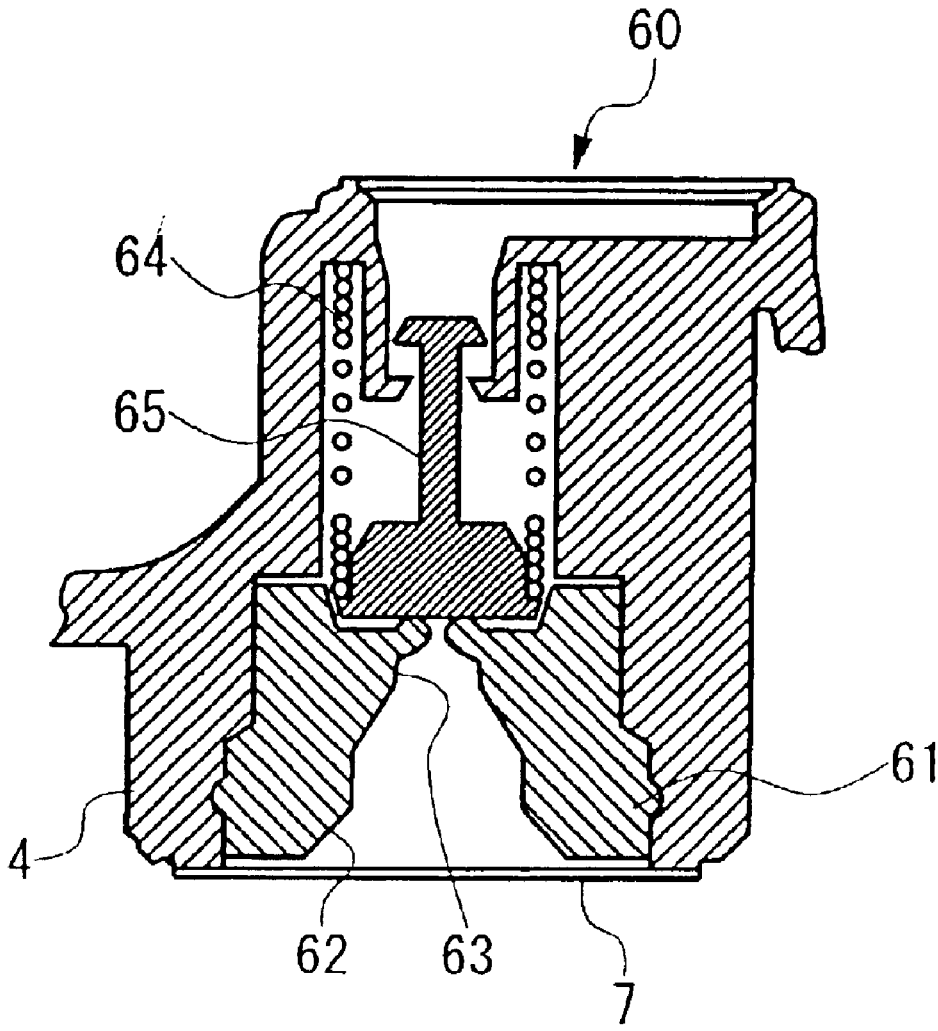
FIG. 5 shows an enlarged cross sectional view of the ink supply port.

FIG. 5 shows an enlarged cross sectional view of the ink supply port 4 and a valve mechanism arranged therein. The packing member 61 is press-fitted in the ink supply port 4. The packing member 61 defines a hole substantially at a center thereof, allowing the ink supply needle 52 to pass therethrough, shown in FIG. 4.

The packing member 61 is made of an elastic material such as a rubber material including a silicon rubber, a chloroprene rubber, a butyl rubber, a ethylene-propylene rubber, a nitrile rubber, and an elastomer material.

The hole of the packing member 61 has a tapered portion 62 which tapers out to guide the ink supply needle 52 of the printing apparatus, and a cylindrical fitting portion 63 in the vicinity of the ink chamber 60. The valve mechanism includes a valve body 65 installed in the ink supply port 4 between the packing member 61 and the ink chamber 60. The valve member 65 is always urged vertically with respect to the packing member 61 by a spring 64. Thus, the valve body 65 and the packing member 61 form a sealing connection. The valve body 65 is urged by the ink supply needle 52 against the resilient force of the spring 64 to open the ink supply port 4, when the ink supply needle 52 is inserted in the ink supply port 4.

The length of the electrode terminals 42 and 43 of the memory device 6 along the direction of insertion of the ink supply needle 52 into the packing member 61 is designed to be longer than the maximum length of entry of the ink supply needle 52 into the ink supply port 4 from the packing member 61, subtracted by a length that the ink supply needle is pushed back by a resilient force of the spring 64 as a reactive force thereof generated by urging the valve body 65. The terminal electrodes are arranged on the substrate of the memory device 6 in a position where the electrode terminals start to connect electrically with the contact member 40 of the printing apparatus when the tip end portion of the ink supply needle 52 comes into contact with the valve body 65. In addition, the length of the electrode terminals along the direction of insertion of the ink supply needle 52 into the packing member is longer than the length that the ink supply needle 52 slides into the housing while pushing the valve body 65 against the resilient force of the spring 64.

Referring back to FIG. 4, when the ink cartridge 1 is mounted on the cartridge holder 70 and a lever 71 is pushed down, the tip of the ink supply needle 52 penetrates the sealing member 7 sealing the ink supply port 4. Then, the tip of the ink supply needle 52 urges the valve body 65 to open against the resilient force of the spring 64 so that the ink chamber 60 becomes held in communication with the printhead 50. The memory device 6 connects to a control unit installed in the printing apparatus, not shown in the drawings, via the contact 40 formed at the cartridge holder 70 in this embodiment. The contact 40 has resiliency in the vertical direction with respect to the insertion direction of the ink supply needle 52.

The memory device 6 according to the present embodiment is mounted on a side wall which is substantially in parallel with the insertion direction of the ink supply needle 52. Therefore, by forming the electrodes 42 and 43 of the memory device 6 slightly larger than the size necessary to contact with the contact 40, the electrode terminals 42 and 43 of the memory device 6 can ensure the connection with the contact 40 of the carriage 51, regardless of the distance between the ink cartridge 1 and the cartridge holder 70 of the printing apparatus. Furthermore, by forming the electrode terminal 42 relatively longer along the insertion direction of the ink supply needle 52, the electrode terminals 42 and 43 of the memory device 6 can ensure the connection between the contact 40 of the cartridge 1 regardless of the insertion direction of the ink supply needle 52. It is desirable that the memory device 6 and the contact 40 are placed such that the contact 40 forms an electric contact with the electrodes 42 and 43 of the memory device 6 only when the ink supply needle 52 is inserted in the ink supply port 4 to open the valve member 65 and ink is supplied from the ink chamber 60 to the printhead 50.

With the afore-described structure, the fact that data from the storage device 44 can be read out means that the ink cartridge 1 is appropriately mounted on the cartridge holder 70, because the storage device 44 can only be read out when the electric connection between the electrodes 42 and 43 and the contact 40 is formed. Therefore, even if a program for controlling the printing operation of the printing apparatus includes a sequence judging that the ink cartridge 1 is mounted on the cartridge holder 70 by the fact that the data can be read out from the storage device 44, there is no danger that the printing apparatus starts printing operation when ink is not provided to printhead 50. Thus, damage to the printhead 50 can be prevented.

With this structure, the printhead 50 can be prevented from sucking air when the ink cartridge 1 is not appropriately mounted on the cartridge holder 70. This fact prevents waste of a large amount of ink for recovering the operation of the printhead 50 that is required when the printhead 50 sucks air or bubbles.

Furthermore, the ink supply port 4 is formed at a position closer to one of the shorter edges than the other of the bottom wall 2*a* of the ink cartridge 1 and is retained at a constant position by the ink supply needle 52 provided on the carriage 51 when the ink supply needle 52 is inserted in the ink supply port 4. Thus, the memory device 6 disposed in the vicinity of the ink supply port 4, which is formed on one wall of the ink cartridge 1, is also retained at a relatively constant position. Therefore, the electric connection between the electrodes 42 and 43 of the memory device 6 and the contact 40 is ensured without changing the position of the memory device 6 even when the carriage 51 traverses and generates shaking.

When the printing operation is started and ink is consumed by the printhead 50, that is, when printhead 50 ejects ink droplets, under this condition, the control unit such as a micro computer, not shown in the drawings, counts ejected ink droplets to calculate the amount of consumed ink. The control unit writes the amount of consumed ink on the semiconductor storage device 44 of the memory device 6 via the contact 40.

It is preferable for the printing apparatus to apply a variety of ink cartridges in accordance with different types of printing mediums in order to enable a high print quality or a desired printing condition.

As shown in FIG. 5, which shows a condition where the ink cartridge 1 or 20 is not in use, the valve body 65 of the ink cartridge 1 or 20 is urged by the spring 64 to close the ink supply port 4. Therefore, even when the ink cartridge 1 or 20 is detached from the carriage 5 for exchange, ink does not leak and undesirable air and bubbles do not enter the ink chamber 60 or 23 to 27.

The length of the terminal along the direction of insertion of the ink supply needle into the packing member and into said valve seat is longer than the maximum length of entry of the ink supply needle into said ink supply port from said valve seat, subtracted by a length that the ink supply needle is pushed back by a resilient force of said elastic member as a reactive force thereof generated by urging said valve body.

As the semiconductor storage device 44 stores information relating to the amount of the consumed ink, the amount of the ink remaining in the ink chamber 60 or 23 to 27 can be calculated, even when the ink cartridge 1 or 20 is detached once and remounted on the ink carriage 51. Thus, an ink end or near end condition of the ink cartridge 1 can readily be detected.

Figure 6:
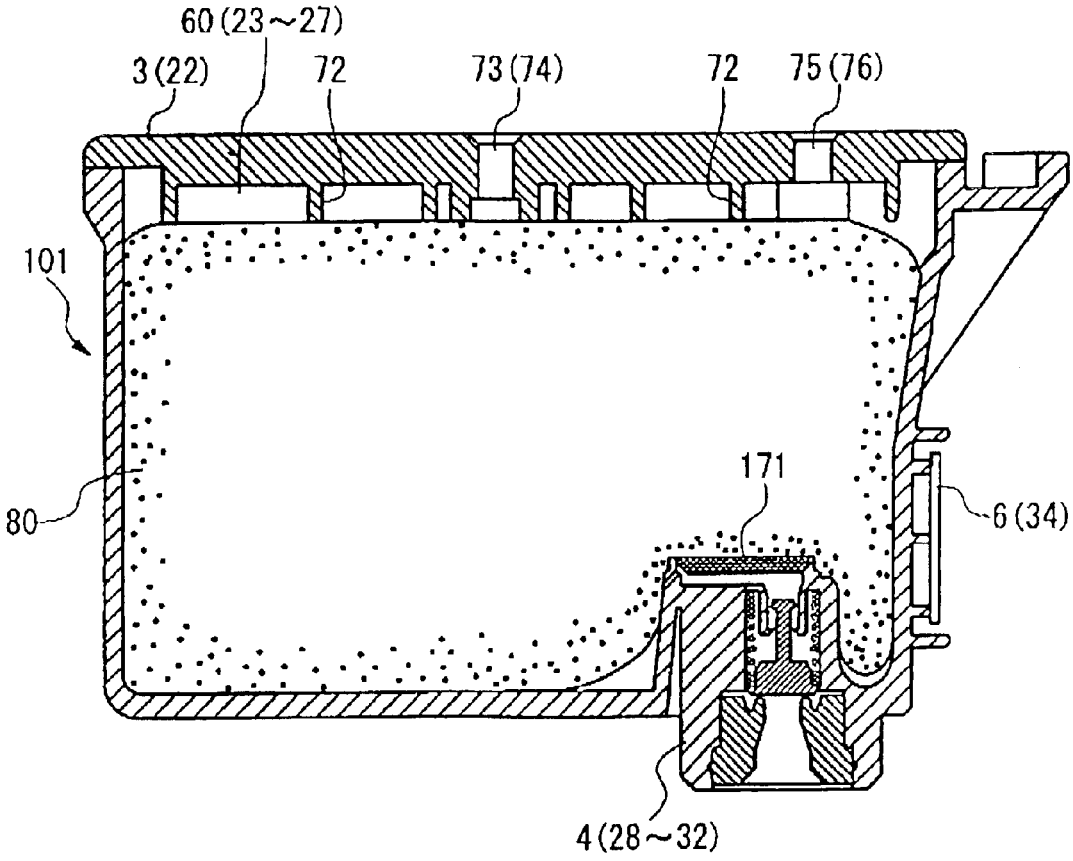
FIG. 6 shows another embodiment of a cartridge according to the present invention.

FIG. 6 shows another embodiment of an ink cartridge according to the present invention. The cartridge 101 includes a porous member 80 and a filter 171 in the ink chamber 60, or 23 to 27. The filter 171 is positioned between the ink chamber and the ink supply port 4 and has a flat shape one side of which is in contact with the porous member 80. The porous member 80 has a capillary force which is smaller than a negative pressure generated by the nozzles of the printhead 50 but large enough to retain ink therein. The filter 171 also has a capillary force which is larger than the capillary force of the porous member 80 and smaller than the negative pressure generated by the printhead 50. The filter 171 may be a plate-like member formed of a porous material or a mesh material. The pore size or mesh size of the porous member 80 and the filter 171 defines the capillary force thereof. In other words, the capillary force of the porous member 80 and the filter 171 can be controlled by selecting an appropriate pore size or mesh size.

A cover member 3 of the ink cartridge 101 is formed with a rib portion including a plurality of protruding portions 72, each of which are spaced apart from each other by a predetermined distance. Owing to these protruding portions '72, a space is defined in the ink chamber 60 between the porous member 80 and the cover member 3 or 22. A part of the ink supply port 4 is formed to protrude inside the ink chamber 60, or 23 to 27.

Therefore, the porous member 80 is highly compressed in the vicinity of the ink supply port 4 to reduce the pore size so that the capillary force of the porous member 80 becomes greater in the vicinity of the ink supply port 4 than other parts of the porous member 80.

The cover member 3 or 22 has an ink injecting hole 73 or 74 and an air hole 75 or 76 which is designed to be open to the external ambient air.

Figure 7A:
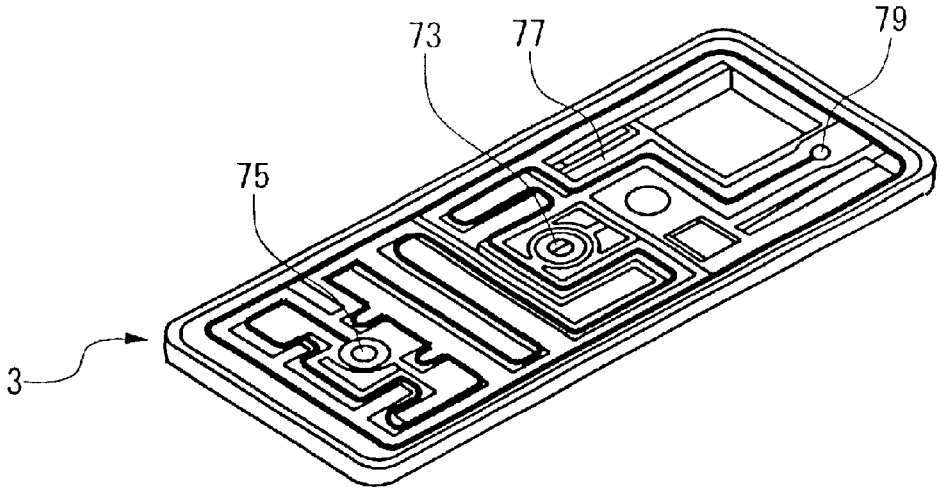
FIG. 7A shows upper side of the cover member of the black ink cartridge.

FIG. 7A is a perspective view showing an upper side of the cover member 3 of the black ink cartridge. The cover member 3 has a fine, winding groove 77 connecting the air hole 75 and an air releasing hole 79. The air releasing hole 79 is previously sealed by a film before use of the ink cartridge, which will be described in the following, but becomes open to the external ambient air when the film is removed for use.

Figure 7B:
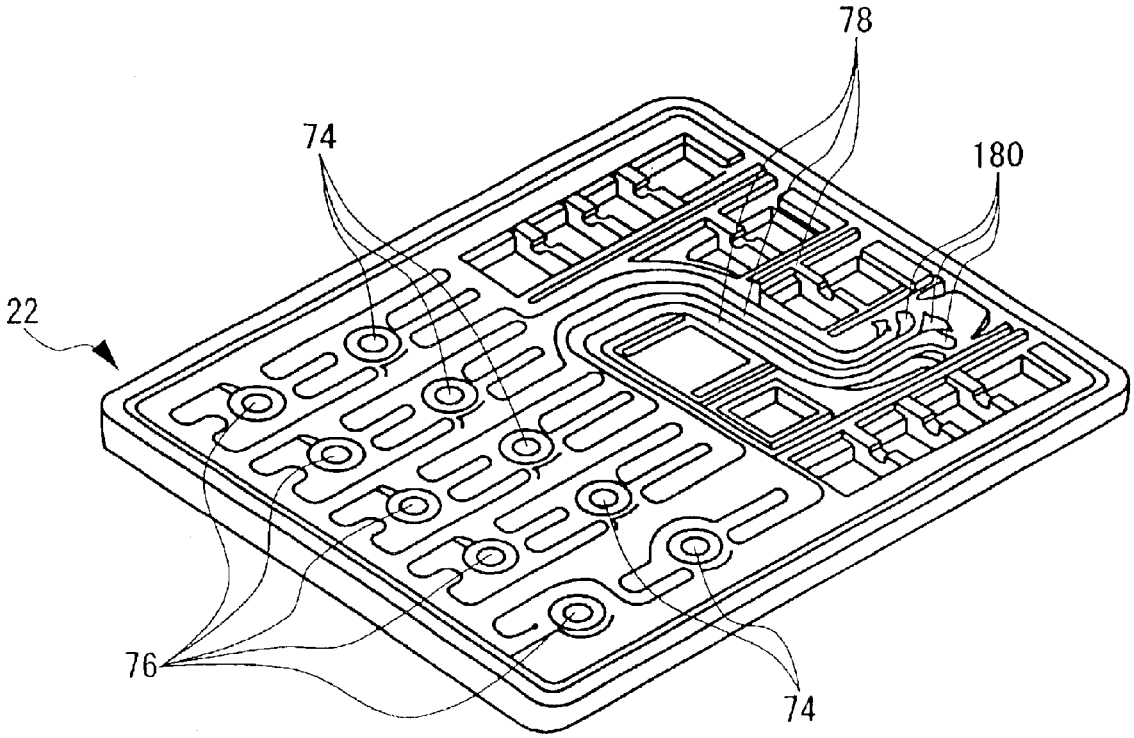
FIG. 7B shows upper side of the cover member 22 of the color ink cartridge.

FIG. 7B is a perspective view showing an upper side of the cover member 22 of the color ink cartridge. The cover member 22 has fine grooves 78 connecting the air hole 76 to air releasing holes 180. The air releasing holes 180 are previously sealed by a film before use of the ink cartridge, which will be described in the following, but become open to the external air when the film is removed for use.

Ink is introduced into the ink chamber of the ink cartridge as will be described in the following. First, the ink supply port 4 is sealed by a film. Then, a hollow ink introducing tube, not shown in the drawings, is inserted in the ink injecting hole 73 or 74, and a vacuum tube is inserted in the air hole 75 or 76. At this time, the ink chamber 60 or 23 to 27 is under a low pressure or a vacuum pressure and the ink is introduced from the ink introducing tube under this condition.

As the ink chamber 60 or 23 to 27 is maintained under the low-pressure condition, i.e., air is removed from the ink supply port 4 or the porous member 80, ink can be introduced entirely into the ink chamber 60 or 23 to 27 with little residual air. Thus, whole of the porous member 80 becomes filled with ink.

Figure 8A:
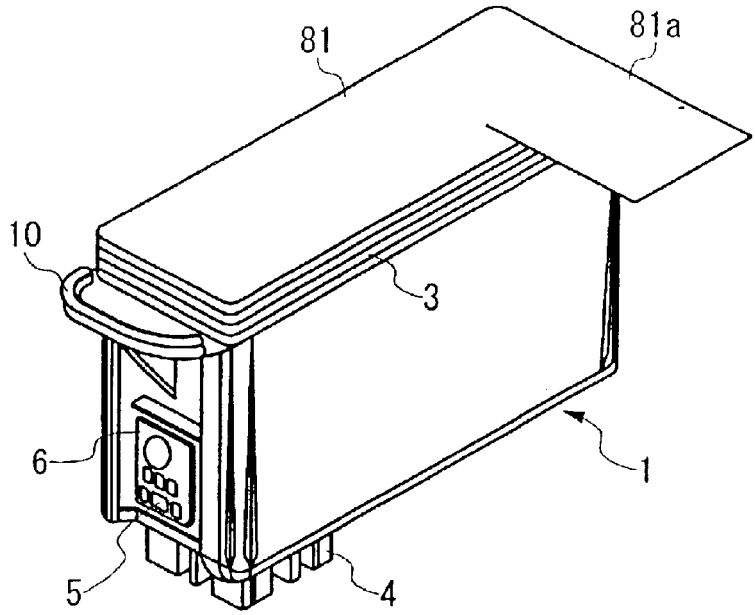
FIG. 8A shows the black ink cartridge with a film.
Figure 8B:
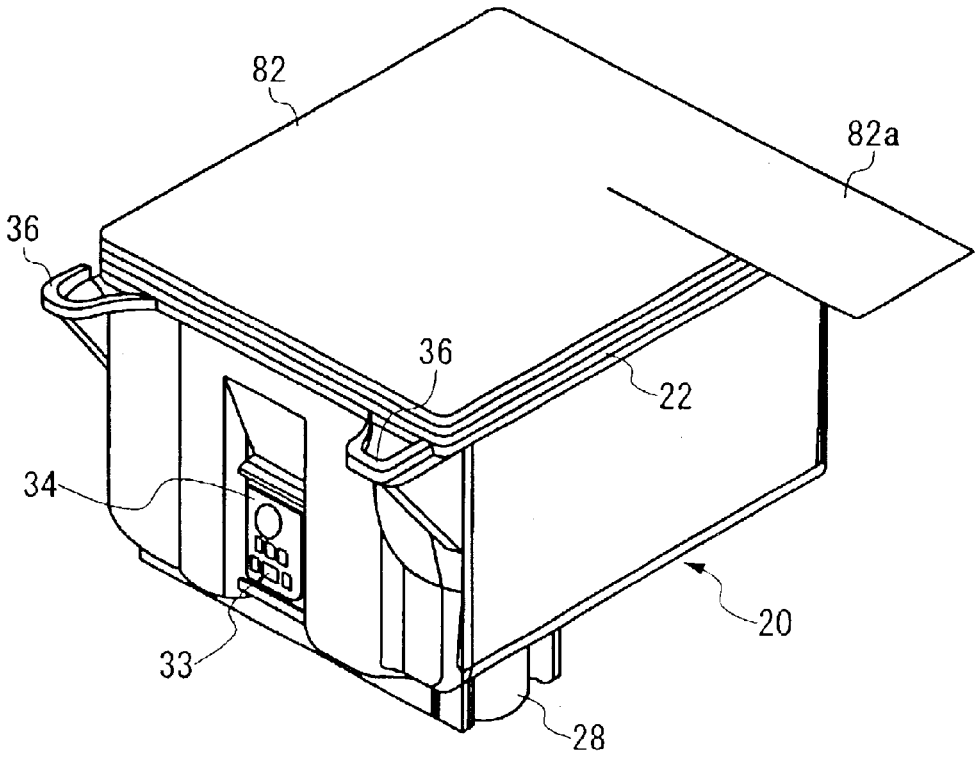
FIG. 8B shows the color ink cartridge with a film.

FIGS. 8A and 8B show the ink cartridges 1 and 2 with films, respectively.

After introducing the ink into the ink chamber 60 or 23 to 27, the ink cartridge 1 or 20 is placed in a vacuum chamber to further decompress the ink chamber 60 or 23 to 27, if necessary. Then, a film 81 or 82 is attached on the surface of the cover member 3 or 22 to protect the ink chamber 60 or 23 to 27 from ambient air. The film 81 or 82 has a tongue part 81*a* or 82*a* for easily removing a part of the film 81 or 82 when it is used. The ink cartridge 1 or 22 is shipped as a product. The ink cartridge may be packaged in a sealed film bag having a high air-impermeability with a decompressed condition, if necessary.

Before using the ink cartridge 1 or 21 thus constructed, a part of the film 81 or 82 is removed by pulling the tongue part 81*a* or 82*a* to open the air releasing hole 79 or 180. Therefore, the ink chamber 60 or 23 to 27 becomes open to the ambient air via a capillary having high fluid resistance formed by the small groove 77 or 78 and the film 81 and 82, respectively.

After the ink cartridge 1 or 22 is mounted on the cartridge holder and the fluid communication with the printhead 50 is accomplished, when printing is started, the negative pressure from the printhead 50 pulls the ink retained by the porous member 80. The filter 171 of the ink cartridge 1 or 20 removes air or dust and passes merely ink to the printhead 50.

As shown in FIG. 5, since the valve member 65 of the ink cartridge 1 or 20 is always urged by the resilient force of the spring 64, the ink supply port 4 is closed by the valve mechanism at a time when the ink supply needle 52 comes out of contact with the packing member 61. Therefore, even when the ink cartridge 1 or 20 is detached from the carriage 5 for changing to a different type of ink for printing, ink does not leak from the ink chamber 60, and undesirable air and bubbles do not enter the ink supply port 4.

Furthermore, in the preferred embodiment, the ink does not leak from the ink supply port 4 even when the sealing connection between the valve member 65 and the packing member 61 becomes loose, because the ink is retained by the porous member 80 in the ink chamber 60 or 23 to 27 and blocked by the filter 171 having a high capillary force. The ink is retained in the ink chamber 60 or 23 to 27 by the fluid resistance of the capillary action performed by the fine groove 77 or 78 and the film 81 and 82, respectively.

In one arrangement of the embodiment, the packing member 61 may have a slit aperture therein at the ink chamber 60 or 23 to 27 side thereof, which slit can be opened by the insertion of the ink supply needle 52 and can retain the ink by generating a capillary force when the ink supply needle 52 is removed. In such arrangement, the valve member 65 may not be necessary. Thus, the structure of the ink cartridge can be further simplified.

As the ink chamber 60 or 23 to 27 is held in communication with the ambient air via the capillary generated by the fine groove 77 or 78 and the film 81 and 82, respectively, evaporation of the ink can also be prevented. Thus, the memory device can accurately store information relating to the amount of the ink remaining in the ink chamber 60 or 23 to 27.

Figure 9:
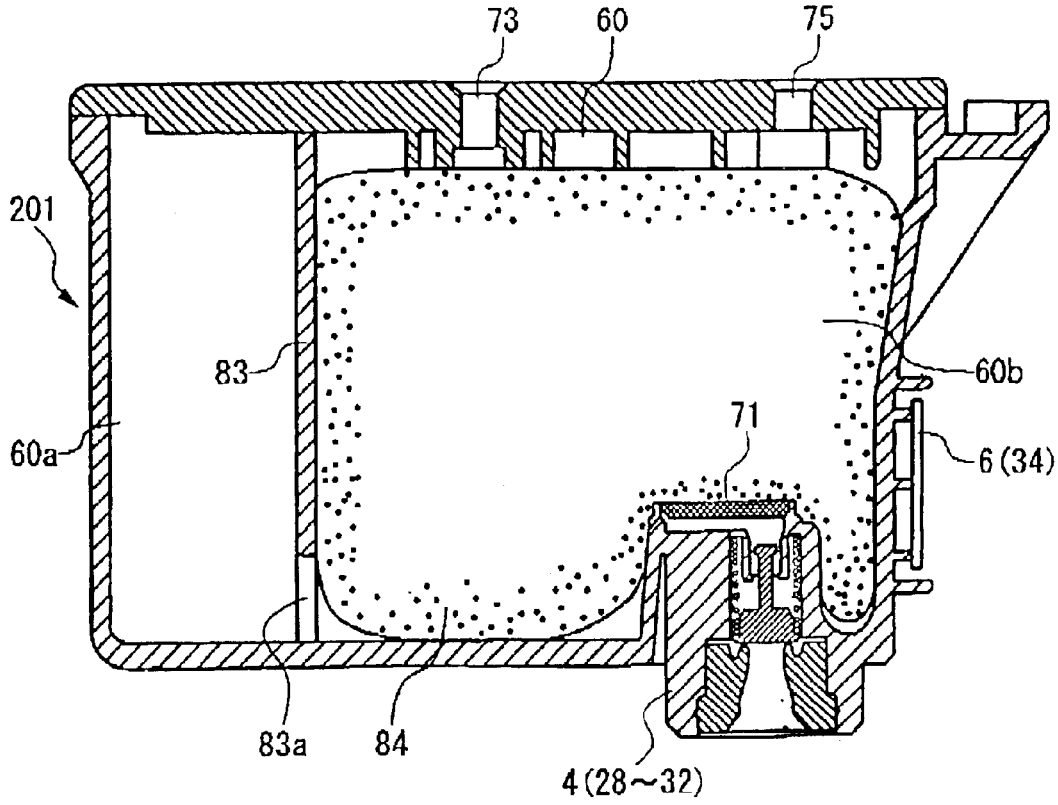
FIG. 9 shows another embodiment of the valve member.

FIG. 9 is a cross-sectional view showing still another example of an embodiment according to the present invention. In the present embodiment, the ink chamber 60 of an ink cartridge 201 may be separated into an ink chamber 60*a* and a foam chamber 60*b* by a partition wall 83 whose bottom portion is formed with a communication hole 83*a* for communicating the ink chamber 60*a* with the foam chamber 60*b*.

The ink cartridge 201 accommodates a porous member 84 in the foam chamber 60*b*. The filter 71, the ink injecting hole 73, and the air hole 75 are provided in the foam chamber 60*b*. The ink chamber 60*a* serves as ink storage. The ink cartridge thus constructed can perform the same operation as that of the ink cartridge in the embodiments described above.

Furthermore, although the porous member 80 or 84 prevents ink from leaking because of its capillary force in the foregoing embodiments, another ink cartridge which includes only the filter 71 or 171, without employing any porous member, can also prevent leakage, to a certain extent, of the ink caused by the weakness of the sealing connection between the valve member 65 and the packing member.

The ink can be introduced into the ink cartridge 1 or 20 thus constructed by using a refilling unit having the same function as the ink supply needle 52. The needle portion of the refilling unit is inserted in the ink supply port 4 to open the valve member 65. Thus, the ink cartridge is recycled. The semiconductor storage device 44 of the memory device 6 may have an area where the number of times of refill of the ink cartridge 1 or 20 can be written in order to regulate the number of recycling or, in other words, to prevent the cartridge from being recycled too many times. Therefore, the recycled cartridge with a high reliability can be produced.

As described above, an ink cartridge for an ink jet printing apparatus according to the present invention having a printhead which ejects ink droplets onto a recording medium and an ink supply needle introducing ink to the printhead, the ink cartridge includes: a substantially rectangular housing containing ink therein, said housing having a first outer wall and a second outer wall which is substantially perpendicular to said first outer wall; an ink supply port formed in said first wall for directing ink in said housing to the printhead; a valve mechanism arranged in said ink supply port comprising: a valve seat allowing the ink supply needle to pass therethrough; a valve body movable along the axis of said ink supply port; and an elastic member biasing said valve body against said valve seat, and a memory device for storing information relating to ink mounted on said second wall of said housing and substantially in parallel therewith, said memory device being formed in the vicinity of said ink supply port and said second wall extending in a direction parallel with a direction along which the ink supply needle is inserted into said valve seat.

Ink is supplied from the ink chamber of the ink cartridge to the printhead of the printing apparatus when the ink supply needle is inserted in the ink supply port of the ink cartridge. As the memory device is attached on the wall of the ink cartridge which is in parallel with respect to the insertion direction of the ink supply needle, the electric connection between the memory device of the ink cartridge and an external electrode of the printing apparatus can be surely maintained regardless of the variation of the distance between the ink cartridge and the printing apparatus caused by the resilient force of the spring biasing the valve body toward the packing member.

What is claimed is:

1. An ink cartridge for detachable mounting on an ink jet printing apparatus having a printhead and an ink supply needle connecting to the printhead, the ink cartridge comprising:

a housing defining an ink chamber containing ink therein;

an ink supply port formed in a wall of said housing for communicating said ink chamber with the printhead through the ink supply needle inserted along a direction into the ink supply port;

a porous member disposed in at least a portion of the ink chamber;

a reseal structure that prevents outward flow of ink through the ink supply port when the needle is not present, at least a part of which is disposed in a region of said ink supply port, and a memory device mounted on a wall of said housing for storing information relating to the ink contained in said ink chamber.

2. The ink cartridge according to claim 1 wherein said porous member is housed in said ink chamber at least in part in the vicinity of said reseal structure.

3. The ink cartridge according to claim 1 further comprising a filter provided upstream of said reseal structure and downstream of said porous member.

4. The ink cartridge according to claim 1 wherein said ink chamber communicates with ambient air through a capillary action formed in a surface of the cartridge body.

5. The ink cartridge according to claim 1 wherein said reseal structure comprising:

a valve seat allowing the ink supply needle to pass therethrough;

a valve body movable along the axis of said ink supply opening; and an elastic member biasing said valve body against said valve seat.

6. The ink cartridge according to claim 5, wherein said memory device comprises a substrate, a plurality of electrode terminals arranged on one surface of said substrate, and a storage device disposed on said substrate.

7. The ink cartridge according to claim 1 wherein a top wall covering an upper opening of said ink chamber is formed with an air hole which communicates with ambient air through fine grooves formed in the surface of said top wall.

8. The ink cartridge according to claim 1 wherein said reseal structure opens and closes said ink supply port in conjunction with the ink supply needle.

9. The ink cartridge according to claim 1, wherein said memory device comprises a substrate, a plurality of electrode terminals arranged on one surface of said substrate, and a storage device disposed on said substrate.

10. The ink cartridge according to claim 9 wherein the length of a selected one of said plurality of electrode terminal along the direction of insertion of the ink supply needle into said valve seat is longer than the maximum length of entry of the ink supply needle into said ink supply port from said valve seat, subtracted by a length that the ink supply needle is pushed back by a resilient force of said elastic member as a reactive force thereof generated by urging said valve body.

11. The ink cartridge according to claim 9 wherein the length of a selected one of said plurality of electrode terminals along the direction of insertion of the ink supply needle into said valve seat is longer than the length that the ink supply needle slides into said housing while pushing said valve body against said elastic member.

12. The ink cartridge according to claim 1, wherein said wall of said ink chamber is formed with an air hole which communicates with ambient air through line grooves formed in the surface of said wall.

13. The ink cartridge according to claim 12 wherein the length of a selected one of said plurality of electrode terminals in a direction in which the ink supply needle comes into engagement with said ink supply opening is longer than the widthwise direction of said terminal.

14. An ink cartridge for detachable mounting on an ink jet printing apparatus comprising:

a cylindrical packing in an ink supply port thereof for communicating an ink chamber with a printhead through an ink supply needle;

a valve body disposed at an upstream side of the cylindrical packing, and always urged by a spring to seal the cylindrical packing to prevent outward flow of ink;

a memory means storing information relating to the ink contained in the ink cartridge, disposed on a wall of the ink cartridge, which wall being in parallel with an insertion direction of the ink supply needle; and a porous member housed in said ink chamber at least in the vicinity of said valve body.

15. The ink cartridge according to claim 14 further comprising a filter provided upstream of said valve body.

16. The ink cartridge according to claims 14 or 15, further comprising a cover plate for sealing an upper part of said ink chamber, said cover plate being formed with an air hole which communicates with ambient air through fine grooves formed in the surface of the cover plate.

17. An ink cartridge for detachable mounting on an ink jet printing apparatus comprising:

a cylindrical packing in an ink supply port thereof for communicating an ink chamber with a print head through an ink supply needle;

a valve body disposed at an upstream side of the cylindrical packing, and always urged by a spring to seal the cylindrical packing to prevent outward flow of ink;

a memory device storing information relating to the ink contained in the ink cartridge, disposed on a wall of the ink cartridge, which wall being in parallel with an insertion direction of the ink supply needle; and a porous member housed in said ink chamber at least in the vicinity of said valve body.

18. The ink cartridge according to claim 17, further comprising a filter provided upstream of said valve body.

19. The ink cartridge according to claims 17 or 18, further comprising a cover plate for sealing an upper part of said ink chamber, said cover plate being formed with an air hole which communicates with ambient air through fine grooves formed in the surface of the cover plate.

* * * * *